United States Patent [19]

Kowalczyk et al.

[11] Patent Number: 4,805,821

[45] Date of Patent: Feb. 21, 1989

[54] AUTOMATIC AMPULE OPENER

[75] Inventors: Ludwik Kowalczyk, Summit; Gilbert C. Kaetzel, Wayne, both of N.J.

[73] Assignee: Hoffmann-La Roche Inc., Nutley, N.J.

[21] Appl. No.: 85,441

[22] Filed: Aug. 14, 1987

[51] Int. Cl.[4] ..... B26F 3/00; A61J 1/08

[52] U.S. Cl. ..... 225/96.5; 225/103

[58] Field of Search ..... 225/93, 96.5, 94–96; 241/99; 30/164.9

[56] References Cited

U.S. PATENT DOCUMENTS

| | | | |
|---|---|---|---|
| 1,315,799 | 9/1919 | Suman | 225/96.5 |
| 2,655,767 | 10/1953 | Wenner | 225/96.5 |
| 3,380,636 | 4/1968 | Ushkow et al. | 225/96.5 X |
| 3,692,220 | 9/1972 | Seng | 225/96.5 |

FOREIGN PATENT DOCUMENTS

| | | | |
|---|---|---|---|
| 357169 | 11/1972 | U.S.S.R. | 225/96.5 |

*Primary Examiner*—Frank T. Yost
*Assistant Examiner*—Michael D. Folkerts
*Attorney, Agent, or Firm*—Jon S. Saxe; Bernard S. Leon; A. Kate Huffman

[57] ABSTRACT

An ampule opener is provided for automatically opening ampules. The ampule opener is especially suitable for use in a robotic sterility test system and is provided with a pneumatic actuator means releasably connected to an ampule opener arm. The head of an ampule is positioned with its neck on a knife edge so that when the ampule opener arm is rotated by the actuator means, the arm applies a pressure on the head of the ampule and the ampule head drops away.

7 Claims, 4 Drawing Sheets

AUTOMATIC AMPULE OPENER

FIELD OF THE INVENTION

The invention relates to a method and apparatus for opening glass ampules. This invention is particularly suitable for use in a robotic sterility test system.

BACKGROUND

Sterility is an essential characteristic of injectable and ophthalmic pharmaceutical products. This characteristic is imparted to the product by virtue of the type of manufacturing process. If during the process, all components, solutions and equipment are pre-sterilized and assembled aseptically, that is, using techniquies which exclude microorganisms, the product is deemed an "aseptic fill". Other injectable products, in addition to the aseptic processing, undergo sterilization when in the final container, typically using steam under pressure. This procedure, if properly designed and executed, results in a terminally sterilized product.

Regardless of the process which yields a sterile product, the characteristic of sterility must be evaluated and adjudged according to an established criterion, using an accepted method. One such method is set forth in the United States Pharmacopeia ("USP"). The UPS recognizes the sterility test as a referee method and one indication of the acceptable performance of the manufacturing process.

A sterility test using membrane filtration described in the UPS involves aseptically opening a number of final product containers, removing the contents, and filtering the product through a bacterial retentive filter. The filter, with any adherent viable microbial cells, is then placed into a microbiological growth medium; it is incubated for a specified period of time, usually 7 to 14 days, and observed regularly for evidence of microbial growth.

In performing the sterility test, care must be exercised to assure the validity of the test. Some of the measures taken to assure proper aseptic technique include the following: all materials used in the test such as forceps, scissors, and the testing apparatus are pre-sterilized. The growth media and the solutions used to rinse membranes are sterilized by autoclaving. Further, the outside of the product containers are disinfected prior to entering the test facility. The test is conducted in a clean room in a certified HEPA filtered, laminar flow hood. To assure the quality of the environment, the area is regularly sanitized and during the test, air quality if monitored. Testing is conducted by personnel, trained in aseptic techniques, who are appropriately dress in clean, sterilized low shedding garments. Finally, negative controls are incorporated into the testing procedure to monitor the quality of the reagents, equipment, and the technique. These stringent procedures are essential for the protection of the product and the environment to prvent the occurrence of extraneou or advetitious contamination.

Although a positive result in a sterility test due to adverntitous contamination may be invalidated because the contamination can be attributed to analytical error, the reality experienced by those involved in interpreting sterility test results is the uncertaintyinherent in assigning the source of contamination to either the testing procedure or to the manufacturing process. There are rarely clear cut ases in which contamination can be attributed "without a shadow of a doubt" to either analytical error, leading to invalidation of the test, or to the manufacturing operation resulting in rejection of the material.

Thus one problem encountered in sterility testing is the need to reduce exposure of the product and the environment to personnel. The transfer of product to the membrane involves many manipulations, each of which could potentially introduce contamination.

One solution to the problems incurred through human contamination is through automation of the sterility test procedure. However, because of the variety of dosage forms testes, that is, ampules, vials, etc., and because of the variety of sizes which have to be accommodated, automation is difficult to accomplish.

A paper entitled, "A Robotic System for the Sterility Testing of Injectables," Barbara J. Zlotnick and Michael L. Franklin, Pharmaceutical Technology, May 1987, describes a robotic system for sterility testing of vials. According to this paper a robot is used to perform sterility testing and minimize the manipulations performed by the analyst, thereby reducing the potential for technical contamination attributable to personnel. Since human intervention is minimized during testing, the environment of the test remains cleaner with respect to viable particulate matter. There is a lower level of human activity and less potential for contamination from shedding or from disruption of the laminarity of the air flow under the hood. A cleaner environment can then be used for a greater proportion of the work day.

While this robotic system is suitable for the sterility testing of product vials it is not entirely satisfactory for the testing of ampules.

Ampules are sealed glass containers having a narrow neck which is scored to permit easy breaking. To open an ampule, the body of the ampule is held while sideways pressure is applied to the head until the head breaks off along the scoreline at the neck. The requirement for manual opening of each ampulte increases the chance of the afore-described technical contamination and thereby reduces the advantages gained by utilizing a robotic sterility test system.

SUMMARY OF THE INVENTION

The present invention concerns an automatic ampule opener and method of operating same which is particularly suitable for use in an automated robotic sterility testing system. The ampule opening according to the invention enables ampules to be automatically opened during the sterility test procedure without the need for human intervention thereby reducing the technical contamination problems heretofore mentioned.

The ampule opener according to the invention includes a support plate, an ampule opener arm rotatably mounted in the support plate, a knife edge which is attached to the support plate and positioned so that when the ampule is placed with its head in the path of the ampule opener arm, the score line on the neck of the ampule contacts the knife edge; an ampule support block which is attached to the support plate and positioned so that when an ampule is positioned as aforementioned the body of the ampule rests against the support block and is restrained from poviting about the knife edge upon application of sideways pressure by the ampule opener arm on the head of the ampule; and means for rotating the ampule opener arm towards the head of the ampule when the ampule is placed in the ampule opener.

In addition, the ampule opener may include a cover for preventing broken ampule heads and/or shattered ampules from flying about the environment of the ampule opener.

A particularly preferred embodiment of the ampule opener further includes a coupling mechanism rotatably mounted in the ampule support plate which is capable of withstanding sterilization in an autoclave. The coupling mechanism includes a first end for receiving the ampule opener arm of the ampule opener and a second end opposite the first end for receiving a drive shaft of a removable actuator mechanism.

DESCRIPTION OF THE PREFERRED EMBODIMENT

Figures 1A, 1B:
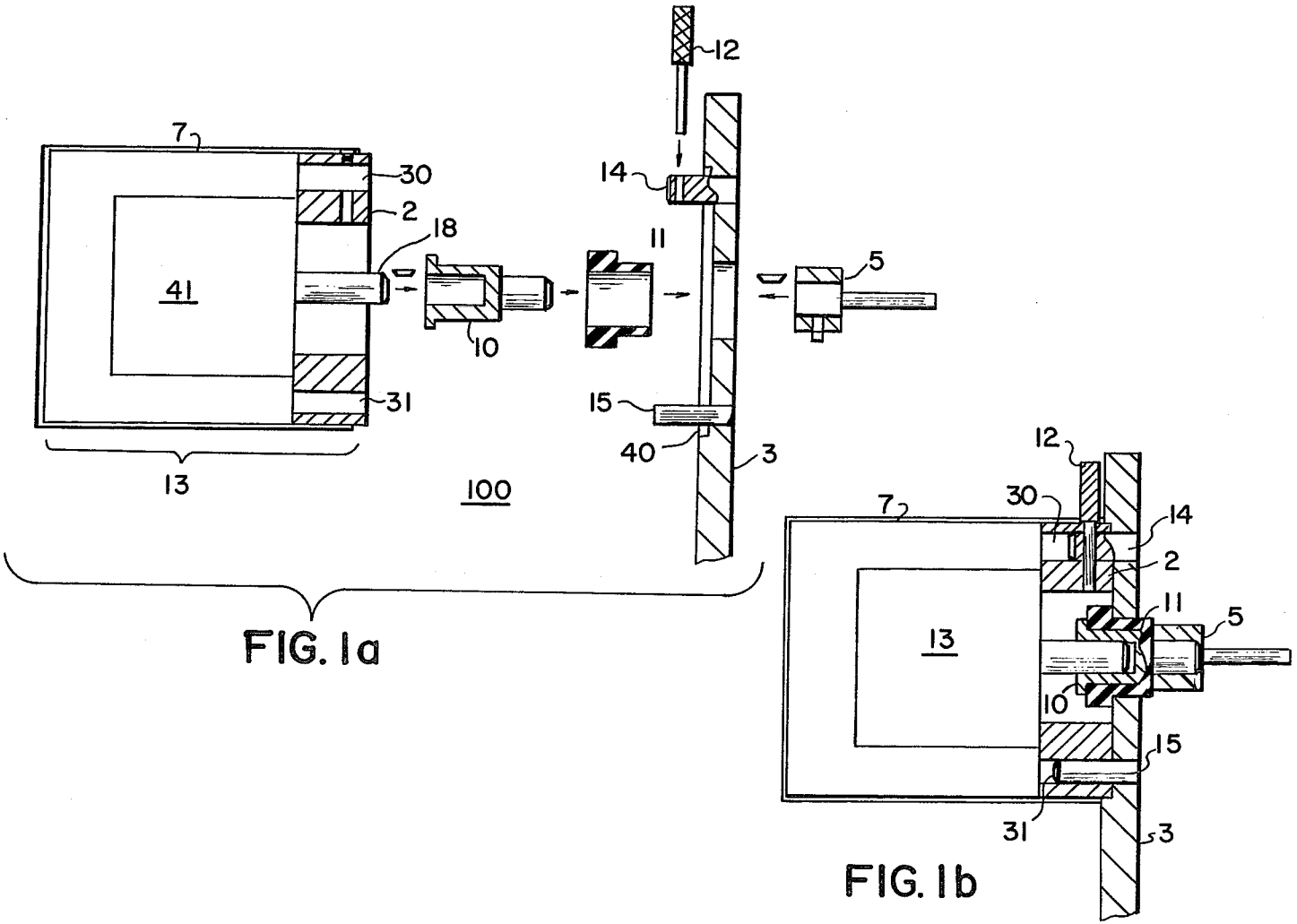
FIGS. 1*a* and 1*b* are a side cross sectional view of an embodiment of the ampule opener according to the invention.

FIG. 1a shows construction details of a preferred embodiment of the ampule opener according to the invention. In pertinent part, from left to right are shown rotary actuator 13 coupling 10, bushing 11, mounting plate 3 and ampule opener arm 5. The rotary actuator 13 is preferably an air driven rotatory actuator which can be obtained from Ex-Cell-O Corp., Berne, Indiana and utilizes an 80 psi air supply. Flor of air to and from the rotary actuator 13 is controlled in conventional manner by valves, not shown.

In the preferred embodiment the ampule opener arm 5 is rotated at the angular velocity of approximately one half revolution per second. In the preferred embodiment the ampule opener arm 5 is roughtly one and one quarter inches long which translates into a velocity of roughly four inches per second at the point where it contacts the ampule. According to the invention, it has been found that this velocity permits the ampule opener to work with a sufficient rate of speed. However, much higher speeds when utilized tend to shatter the ampules.

The rotary actuator 13 includes an actuator drive 41 which has a drive shaft 18 which fits via a keyed slot into a left hand end of coupling 10. The coupling 10 in turn is rotatably mounted in bushing 11 which itself is mounted in mounting plate 3, preferably by press fit. Rotary actuator 13 also includes a coupling plate 2 and an actuator guard 7. The coupling plate 2 is bored to provide bore holes 30 and 31, respectively for positioning pins 14 and 15 to be received therein.

It is contemplated that the ampule opener arm 5 might be replaced, alternatively, by a push rod assembly using a linear actuator such as a double acting piston, not shown.

The positioning pins 14 and 15 are preferably mounted in mounting plate 3. Additionally, pin 14 and the corresponding bore hole 30 have a different diameter than pin 15 and its corresponding bore hole 31. Accordingly, the coupling plate 2 can be precisely oriented when installed in the mounting plate 3. The coupling plate 2 is secured in its mounted position by set pin 12 which passes through coupling plate 2 and interlocks with positioning pin 14. To aid in obtaining proper orientation, the mounting plate 3 may have a recess 40, as shown, for receiving the coupling plate 2.

Ampule opener arm 5 is attached to the right hand side of coupling 10, preferably by a keyed slot and set screw arrangement, as shown. The various elements described above in reference to FIG. 1a are shown in their assembled state in FIG. 1*b*.

Figure 2C:
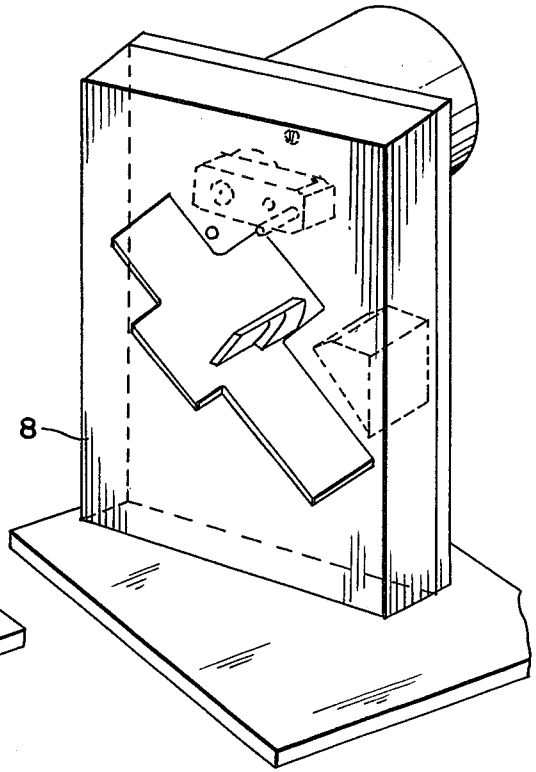
FIGS. 2*a*–2*c* and 3 show perspective views of the ampule opener according to the invention.
Figure 2B:
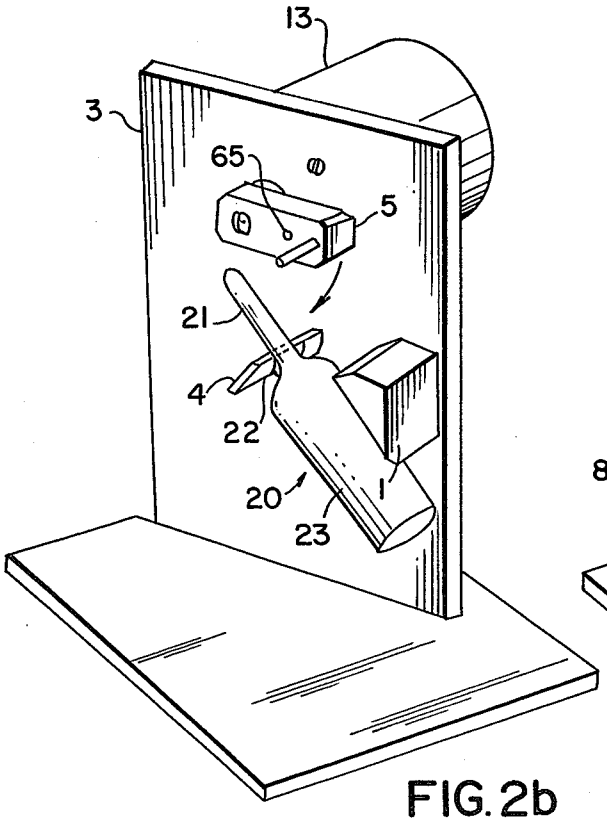
Figure 2A:
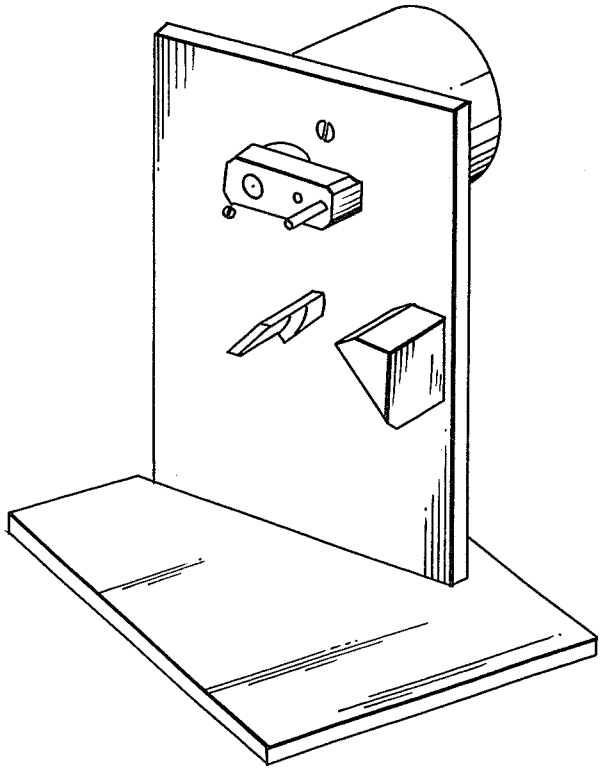

Turning to FIG. 2*a*, the ampule opener arm 5 is shown in a return position where it is normally located during assembly and disassembly of the actuator 13 from the ampule opener and during idle periods. As can be seen in FIG. 2*b*, an ampule 20 has been placed in the ampule opener assembly. The ampule 20 has a head 21, a scored neck area 22 (the score is shown by dotted line) and a body 23.

During operation, the ampule opener arm 5 swings down to contact the head 21 of the ampule 20. The ampule 20 is positioned so that the scoring on the neck 22 lies against the knife edge 4. As the opener arm 5 contacts the head 21 and the ampule tries to pivot about the knife edge 4, the body 23 of the ampule 20 contacts the ampule support 1. As pressure builds up on the head 21 of the ampule 20 it breaks away along the score line on the neck 22. The ampule may then be removed from the ampule opener assembly and processed in conventional manner using, for example, a robotic sterility test system.

Additionally, the knife edge 4 and ampule support 1 are preferably positioned so that the ampule can be positioned at approximately a 45 degree angle from the horizontal. This angle keeps any particles which may be suspended in the surrounding air from entering into the ampule after opening without spilling the contents of the ampule.

Figure 3:
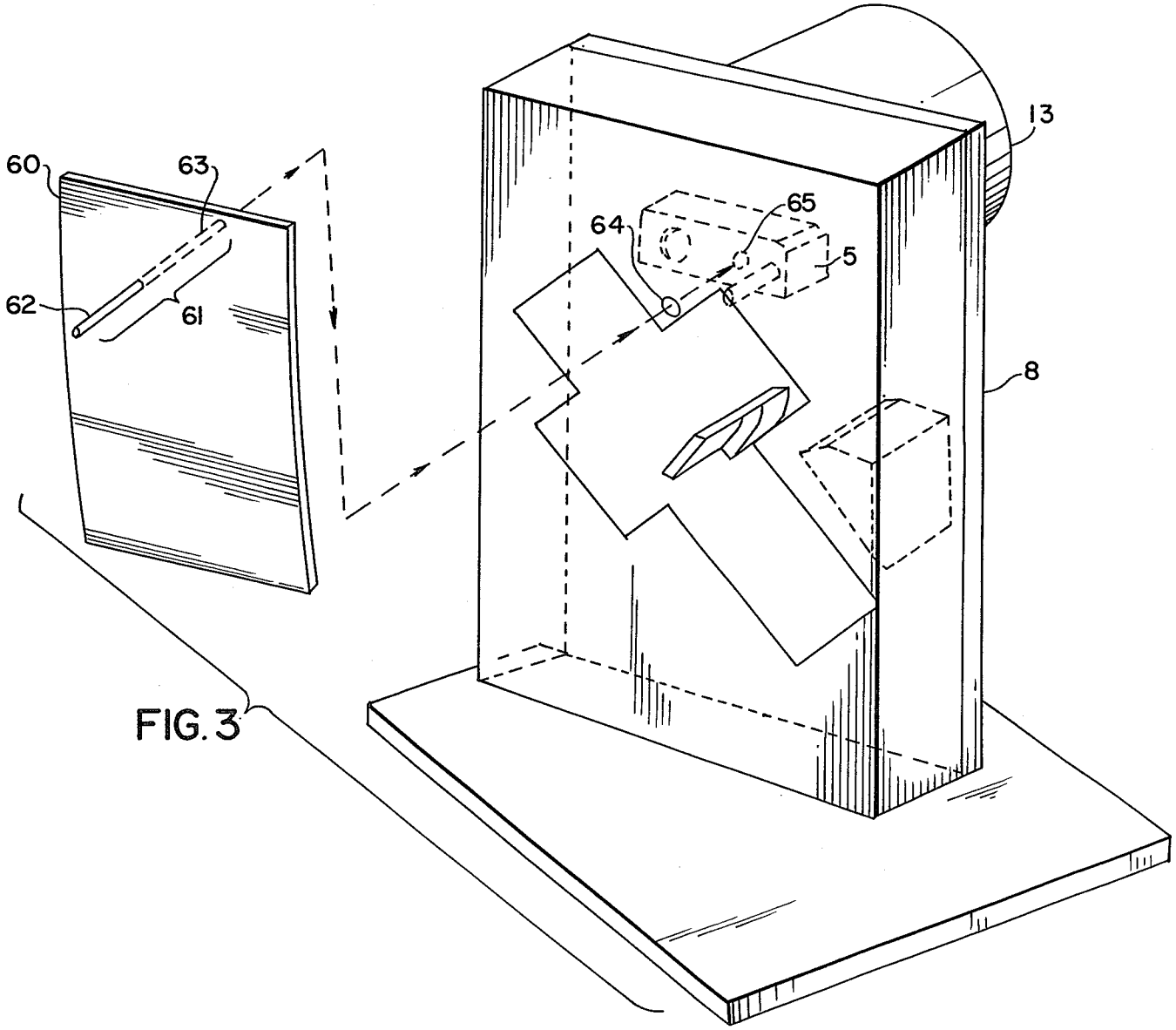

With reference to FIG. 3, a plate 60 is shown. The plate 60 has a dowel 61 extending therethrough. A first end 62 provides a handle. The second end of the dowel 63 fits through a hole 64 in the cover 8 and into a hole 65 in ampule opener arm 5.

The plate 60 serves two functions when in place. During sterilization, it prevents steam from condensing within the cover 8. Second, the dowel 61 holds the ampule opener arm 5 in the position shown for easy removal and reassemblyof rotary actuator 13.

Figure 4:
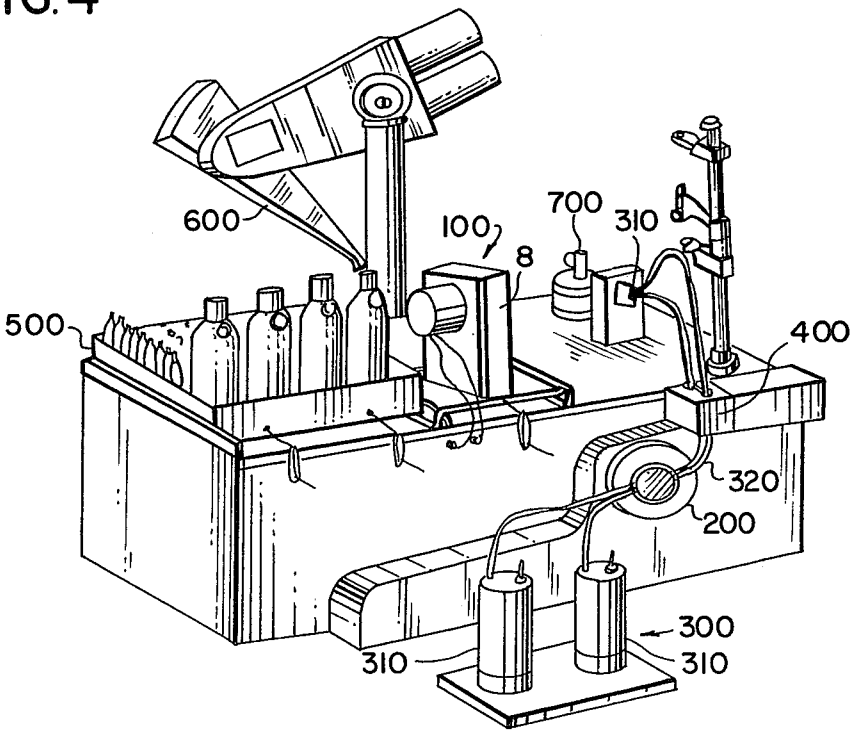
FIG. 4 shows in perspective a robotic sterility test system employing the ampule opener according to the invention.

Turning now to FIG. 4 the ampule opener 100 according to the invention is shown positioned in a robotic sterility test system. As shown in FIG. 3, the cover 8 has been installed. The cover 8 serves to collect broken heads 21 and additionally in the event that an ampule shatters during the opening process the contents are contained within the cover 8 and do not contaminate the surrounding environment. For clarity of illustration, a laminar flow hood which the robotic sterility test system would normally be housed in has not been shown. In this type of hood arrangement air moves in laminar fashion from to bottom.

The system includes a sample rack 500 which would hold the ampules to be tested during the robotic sterility testing procedure. In operation the robot arm 600 would pick up each ampule individually and position it within the ampule opener 100 wherein the head of the ampule would be broken off as described previously. Next, the ampule would be withdrawn from the ampule opener and passed twice through a light beam, not shown, first to check if the ampule has been opened and second, to check if the ampule has been shattered. Assuming the ampule has been opened and has not been shattered, the product contained within the ampule would then be withdrawn for sterility testing.

Withdrawal of product from the ampule is accomplished in the following manner using the Millipore test system 300 which consists of two filter canisters and a cannula 310 individually connected to each conaister by tubing 320. The tubing 320 passes through a two-day peristaltic pump 200 and pinch block 400. The ampule is positioend with the cannula 310 inside and peristaltic pump 200 withdraws the contents of the ampule and passes it through the canisters 310. After the collected product from a sufficient number of ampules has been passed through the canisters 310, the canisters are then processed in known manner to check for sterility of the product contained within the ampules. As an added check on the sterility of the environment, the system also employs a conventional air quality monitoring device 700.

One advantage provided by the ampule opener according to the present invention is the ability to autoclave and thereby sterilize all parts of the system which can come in contact with the ampule. Since the rotary actuator is generally not capable of withstanding the auto claving operation, the design of the ampule opener according to the invention allows the actuator assembly to be easily removed prior to and repositioned following autoclaving.

For sterilization, the rotary actuator 13 is removed and can be chemically disinfected in conventional manner. The remaining parts, including coupling 10, bushing 11, mounting plate 3, pins 12, 14 and 15 and opener arm 5 should all be capable of withstanding autoclaving. Preferably, the bushing 11 is constructed from a low friction material such as Delrin TM acetal, the cover 8, coupling 10, ampule opener arm 5, knif eedge 4 and ampule support 1 are constructed from type 316 stainless steel, and all remaining parts are preferably constructed of aluminum to reduce the weight.

It is recognized that the foregoing description of the preferred embodiment is provided for illustrative purposes only and that many variations of the cliamed invention which may occur to one having ordinary skill in the art are possible.

We claim:

1. An ampule opener for opening an ampule having a head, neck including a score line and a body, said ampule opener comprising:

a mounting plate;

an ampule opener arm rotatably mounted in the mounting plate;

pneumatic actuator means releasably connected to the ampule opener arm for rotating the arm toward the head of the ampule and for providing a predetermined build up of pressure by the rotating arm at a point of contact with the head of the ampule;

a knife edge attached to the mounting plate and positioned so that an ampule may be placed in the ampule opener with its neck on the knife edge and its head extending into the path of the ampule opener arm when the ampule opener arm is rotated; and an ampule support block attached to the mounting place and positioned to contact the body of the ampule and prevent the ampule from pivoting about the knife edge when pressure is applied by the opener arm on the head of the ampule;

whereby when the ampule opener arm is rotated and contacts the head of the ampule and the predetermined build-up of pressure is exerted thereon by the rotating arm, the neck of the ampule is broken along the score line and the head of the ampule drops away.

2. The ampule opener of claim 1 further comprising coupling means mounted in the mounting plate for releasably coupling the pneumatic actuator means to the ampule opener arm.

3. The ampule opener according to claim 2, further comprising positioning means for accurately positioning the pneumatic actuator means in relation to the ampule opener arm and mounting plate during assembly and disassembly of the actuator means from the ampule opener.

4. The ampule opener according to claim 1, wherein the ampule opener arm is configured and dimensioned to rotate at an angular velocity of approximately one half revolution per second.

5. The ampule opener of claim 4 wherein the ampule opener arm is about one and one quarter inches long and has a velocity of about four inches per second at the point where the ampule opener arm contacts the head of the ampule.

6. An ampule opener for opening an ampule having a head, a neck including a score line and a body, said ampule opener comprising:

a mounting plate;

an ampule opener arm rotatably mounted in the mounting plate;

pneumatic actuator means releasably connected to the ampule opener arm for rotating the arm toward the head of the ampule at an agular velocity of approximately one half revolution per second and for providing a predetermined build up of pressure by the rotating arm at a point of contact with the head of the ampule;

a knife edge attached to the mounting plate and positioned so that an ampule may be placed in the ampule opener with its neck on the knife edge and its head extending into the path of the ampule opener arm when the ampule opener arm is rotated; and an ampule support block attached to the mounting plate and positioned to contact the body of the ampule and prevent the ampule from pivoting abouth the knife edge when pressure is applied by the opener arm on the head of the ampule;

whereby when the ampule opener arm is rotated and contacts the head of the ampule and the predetermined build up of pressure by the rotating arm is exerted thereon, the neck of the ampule is broken along the score line and the head of the ampule drops away.

7. The ampule opener of cliam 6, wherein the ampule opener arm is about one and one quarter inches long and has a velocity of about four inches per second at the point where the ampule opener arm contacts the head of the ampule.

* * * * *